US007198473B2

(12) United States Patent
Stickland et al.

(10) Patent No.: US 7,198,473 B2
(45) **Date of Patent: *Apr. 3, 2007**

(54) INTEGRATED AIR COMPRESSOR

(75) Inventors: Mark Stickland, Cornelius, NC (US); Jason Hunt, Mooresville, NC (US); Stephen Sharp, Cornelius, NC (US)

(73) Assignee: Ingersoll-Rand Company, Montvale, NJ (US)

( * ) Notice: Subject to any disclaimer, the term of this patent is extended or adjusted under 35 U.S.C. 154(b) by 657 days.

This patent is subject to a terminal disclaimer.

(21) Appl. No.: 10/680,014

(22) Filed: Oct. 7, 2003

(65) Prior Publication Data

US 2004/0071567 A1 Apr. 15, 2004

Related U.S. Application Data

(63) Continuation of application No. 10/011,470, filed on Nov. 5, 2001, now Pat. No. 6,629,825.

(51) Int. Cl.
*F04B 17/00* (2006.01)

(52) U.S. Cl. ..... 417/362; 417/313; 418/DIG. 1

(58) Field of Classification Search ..... 417/362, 417/360, 313; 418/DIG. 1
See application file for complete search history.

(56) References Cited

U.S. PATENT DOCUMENTS

| | | | | |
|---|---|---|---|---|
| 1,906,533 | A | | 5/1933 | Burke |
| 2,136,098 | A | | 11/1938 | Browne |
| 4,341,506 | A | | 7/1982 | Klein |
| 4,741,676 | A | | 5/1988 | Janes |
| 4,768,930 | A | * | 9/1988 | Grime et al. ..... 417/362 |
| 5,030,067 | A | | 7/1991 | Ushiota et al. |
| 5,082,428 | A | | 1/1992 | Oklejas et al. |
| 5,106,270 | A | | 4/1992 | Goettel et al. |
| 5,159,820 | A | | 11/1992 | Ohishi et al. |
| 5,199,858 | A | | 4/1993 | Tsuboi et al. |
| 5,378,119 | A | | 1/1995 | Goertzen |
| 5,449,277 | A | | 9/1995 | Hood |
| 5,507,618 | A | | 4/1996 | Kubo et al. |
| 5,613,843 | A | | 3/1997 | Tsuru et al. |
| 5,720,599 | A | | 2/1998 | Myers |
| 5,795,136 | A | | 8/1998 | Olsaker et al. |
| 5,820,352 | A | | 10/1998 | Gunn et al. |
| 5,873,708 | A | | 2/1999 | Delhomme, II et al. |
| 6,010,320 | A | | 1/2000 | Kwon |

(Continued)

*Primary Examiner*—Charles G. Freay
(74) *Attorney, Agent, or Firm*—Michael Best & Friedrich LLP

(57) ABSTRACT

An air compressor unit having an enclosure with a base. A motor is rigidly mounted to the base, and the motor drives both an airend and an impeller. The airend is pivotally mounted with respect to the base. The airend is directly connected to a horizontal separator tank, and the separator tank supports the airend. The airend and separator tank comprise a single integrated unit, and the separator tank is pivotally mounted to the base. The motor is a dual shafted motor having a drive side shaft and a non-drive shaft extending from opposite ends of the motor. A drive system is coupled to the drive side shaft and transfers power from the motor to the airend. The drive system is a belt and pulley system, and the airend is pivoted with respect to the motor to adjust belt tension. The impeller is coupled to the non-drive side shaft.

9 Claims, 5 Drawing Sheets

U.S. PATENT DOCUMENTS 6,099,267 A 8/2000 Ames et al.
6,102,679 A 8/2000 Brown
6,220,825 B1 4/2001 Myers et al.
6,499,965 B2 12/2002 Cook et al.
6,520,758 B1 * 2/2003 Sowards ..... 418/203
6,629,825 B2 * 10/2003 Stickland et al. ..... 417/362

* cited by examiner

INTEGRATED AIR COMPRESSOR

RELATED APPLICATIONS

This application is a continuation of U.S. patent application Ser. No. 10/011,470, filed on Nov. 5, 2001, now U.S. Pat. No. 6,629,825.

FIELD OF THE INVENTION

This invention relates generally to compressor systems, and more particularly to air compressor systems.

BACKGROUND OF THE INVENTION

Air compressor systems compress air to pressures above normal atmospheric pressures. Compressor systems generally include several components disposed within a housing. Examples of these components include a motor and drive train assembly, an airend or compressor module, a separator tank, and a fan. The fan creates an air flow through the housing to cool the components of the compressor system and provide air for the airend. The motor may drive the airend through a belt and pulley system that transfers power from the motor to the airend. In some prior art arrangements, the motor is pivotally mounted to the housing and base, and pivots to achieve belt tensioning. In some of those prior art compressor systems, the main motor shaft that drives the airend also drives the fan, but because the motor is pivotally mounted the fan must be a propeller fan due to the tolerances required. Prior art systems which employ a more efficient impeller fan require separate motors to drive the fan and the airend.

SUMMARY OF THE INVENTION

The invention relates to an improved integrated air compressor system having an enclosure, a motor, an airend, a separator tank, and an impeller. The enclosure has a base, and the motor is rigidly mounted to the base. The airend is directly mounted to the separator tank, and the separator tank is pivotally mounted to the base. The airend and separator tank may pivot with respect to the motor.

A drive system transfers power from the motor to the airend. The drive system may comprise a first pulley, a second pulley, and a belt. The motor has an output shaft, and the first pulley is coupled to the output shaft of the motor. The airend has an airend shaft, and the second pulley is coupled to the airend shaft of the airend. The belt is interconnected to the first pulley and second pulley, and transfers power from the first pulley to the second pulley to drive the airend. The airend and separator tank may pivot with respect to the motor to adjust the belt tension.

The motor preferably includes an output shaft having a drive side shaft end extending from a first end of the motor, and a non-drive side shaft end extending from the opposite end of the motor. As described above, the drive side shaft end is interconnected to the drive system, and drives the airend. An impeller is preferably mounted to the non-drive side shaft end, and the motor drives the impeller. An inlet cone supported by the base is disposed near the impeller, and the impeller creates an air flow within the enclosure. Since the motor is rigidly mounted to the base, tight tolerances can be maintained between the impeller and the inlet cone.

Figure 1:
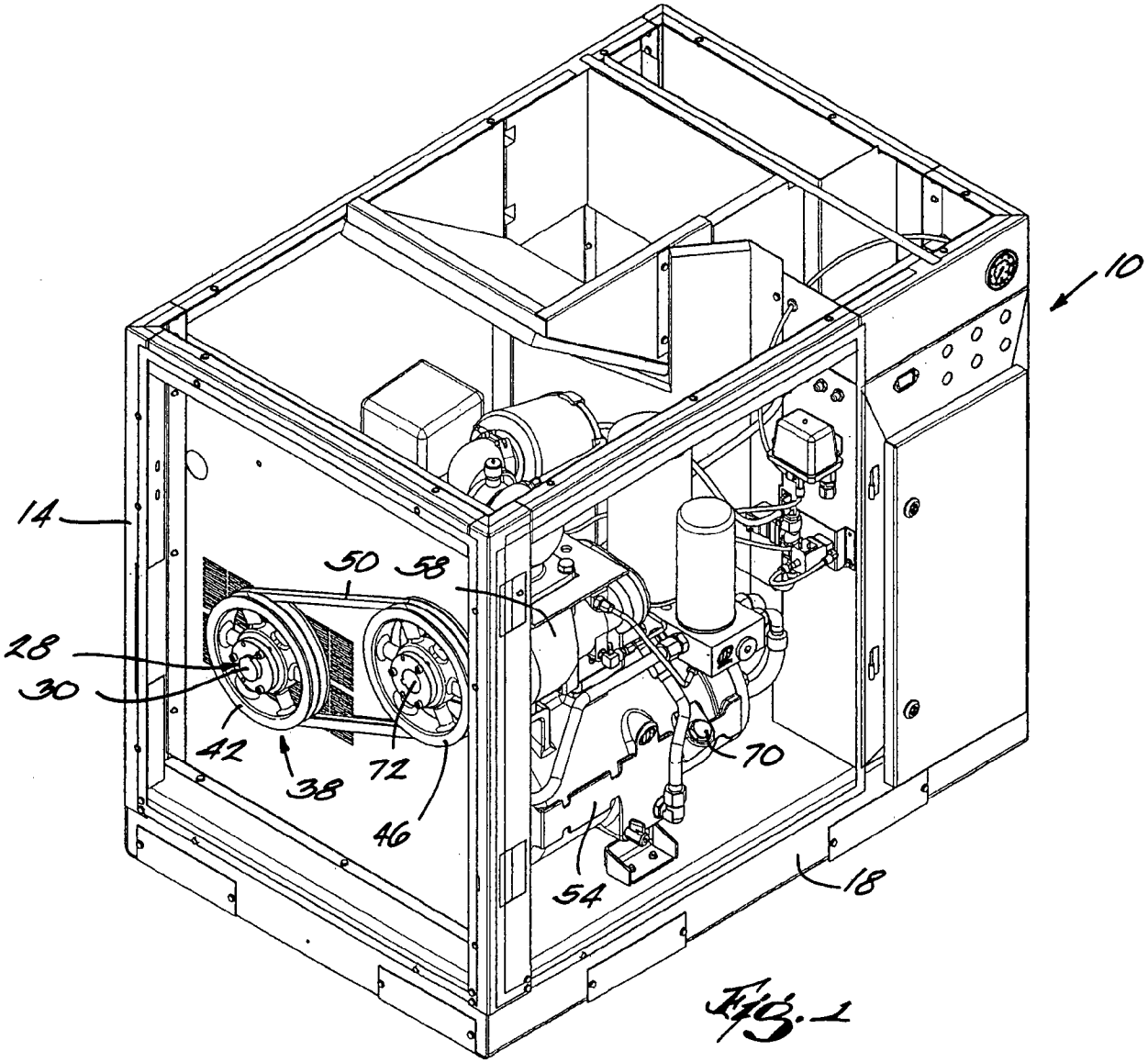
FIG. 1 is a perspective view of a compressor system embodying the invention.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

Although references are made below to directions, such as left, right, up, down, top, bottom, front, rear, back etc., in describing the drawings, they are made relative to the drawings (as normally viewed) for convenience. These directions are not intended to be taken literally or limit the present invention in any form.

DETAILED DESCRIPTION

Figure 2:
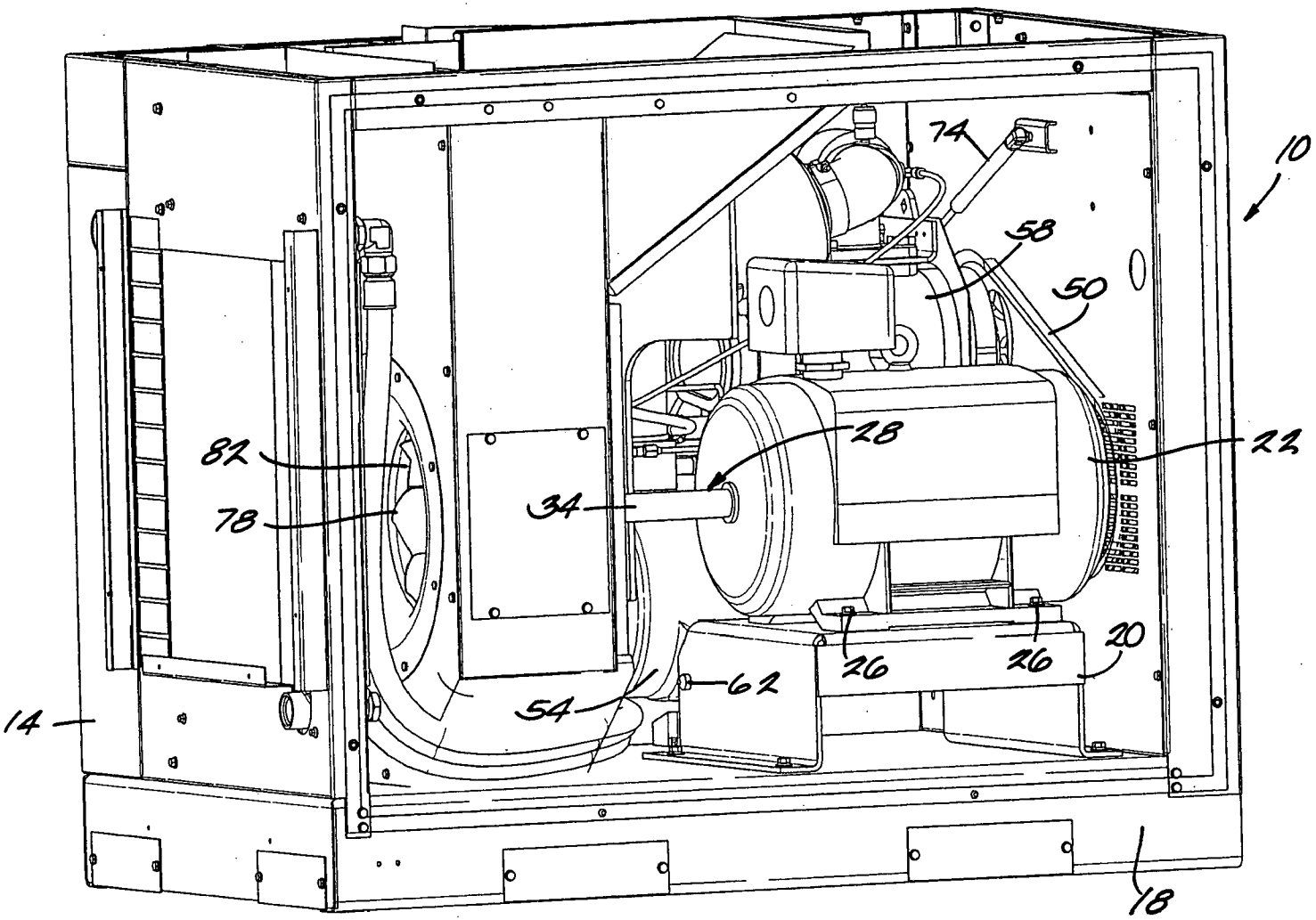
FIG. 2 is another perspective view of the compressor system of FIG. 1.

FIG. 1 illustrates a compressor system 10 embodying the present invention. The compressor system 10 has an enclosure 14, and several components of the compressor system 10 are disposed within the enclosure 14. FIG. 1 illustrates the compressor system 10 with side and top panels removed. As shown in FIG. 2, the enclosure 14 has a substantially rectangular, box-shaped frame, and includes a bottom portion 18 that comprises the lower portion of the enclosure 14. FIG. 2 also illustrates the compressor system 10 with side and top panels removed. A base 20 extends upwardly from the bottom portion 18, and is rigidly mounted to the bottom portion 18. A motor 22 is rigidly mounted to the top surface of the base 20. In the illustrated embodiment, the motor 22 is fastened to the base 20 with bolts 26. Alternatively, the motor 22 could be welded to the base 20, or screws, rivets, or other conventional fasteners could be used to mount the motor 22 to the base 20.

Figure 3:
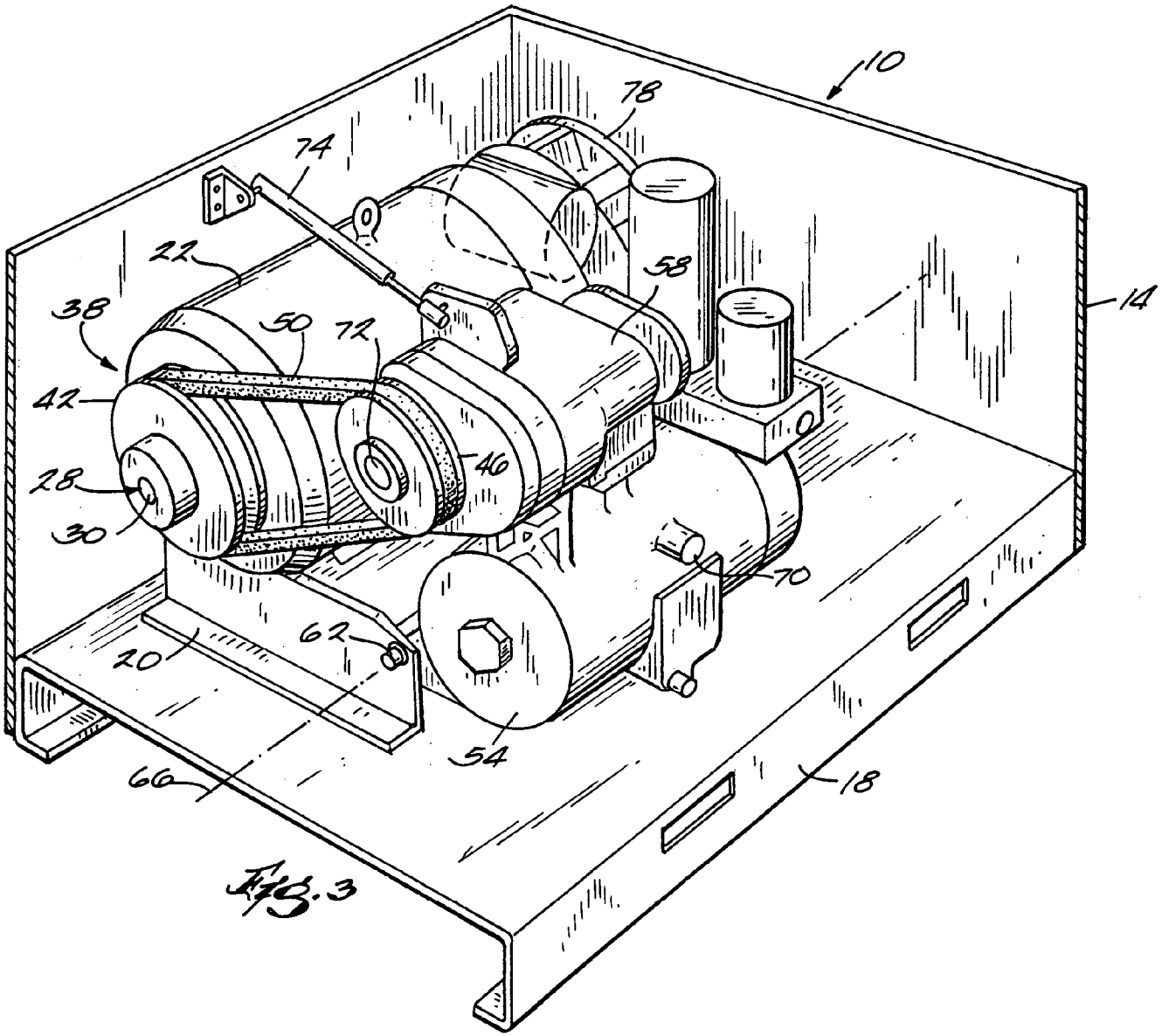
FIG. 3 is another perspective view of the compressor system of FIG. 1.
Figure 4:
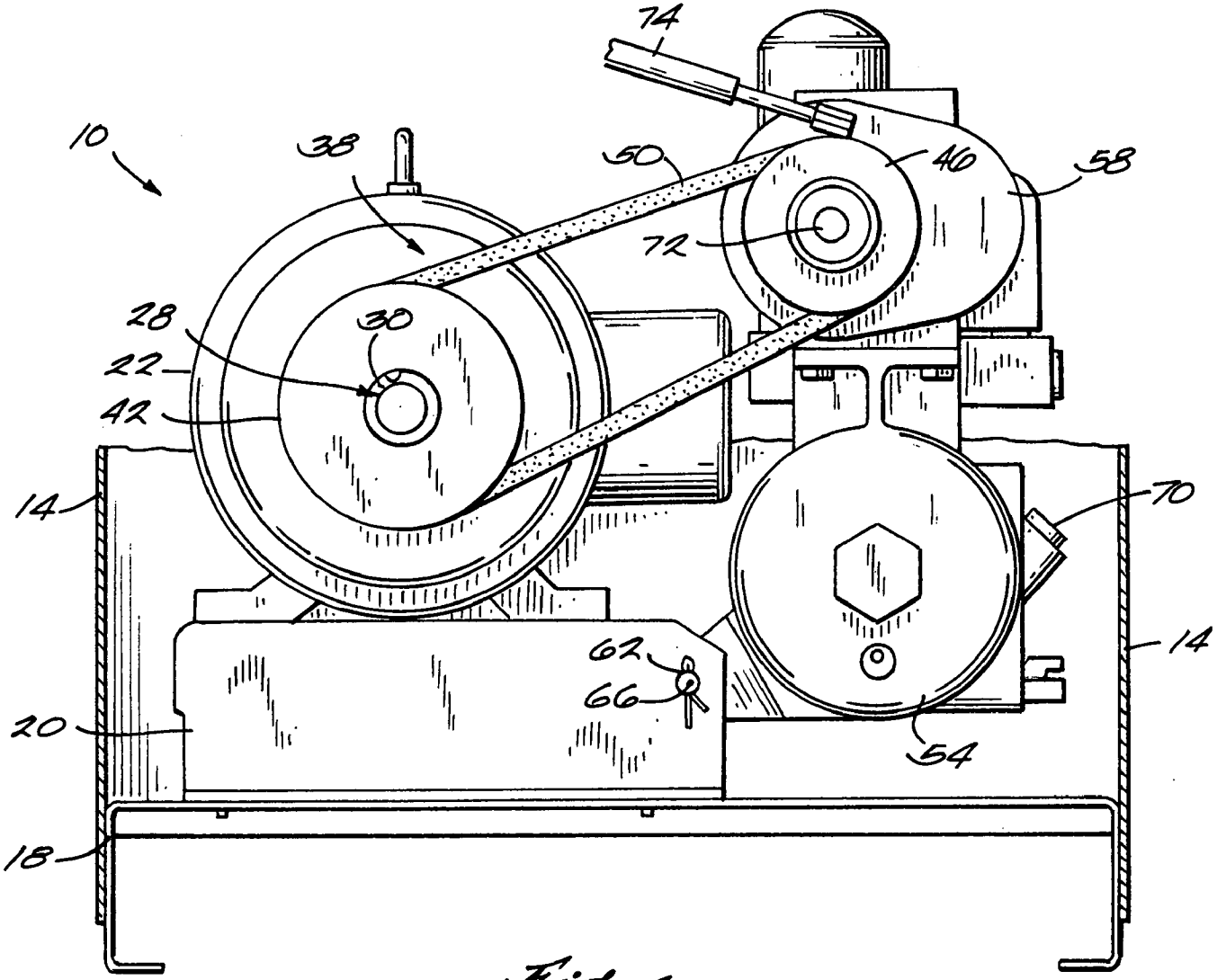
FIG. 4 is an elevation view of the compressor system of FIG. 1.

The motor 22 is a dual shafted motor with the ends of an output shaft 28 extending from opposite sides of the motor 22. The output shaft 28 includes a drive side shaft end 30 and a non-drive side shaft end 34 that extend from opposite sides of the motor 22. As shown in FIG. 3, the drive side shaft 30 is interconnected to a drive system 38. In the illustrated embodiment, the drive system 38 is a belt and pulley configuration, and comprises a first pulley 42, a second pulley 46, and a belt 50. The first pulley 42 is mounted to the drive side shaft 30, and rotates in response to rotation of the motor 22. Alternatively, the drive system 38 could comprise a sprocket and chain configuration, a gearing configuration, or a similar power transfer mechanism.

In the illustrated embodiment, the compressor system 10 includes a separator tank 54 and an airend 58. The separator tank 54, which functions to separate oil from the compressed air and to return that oil to the airend 58, is coupled to the base 20 to pivot with respect to the base 20. The separator tank 54 and base 20 are coupled with at least one pivot point.

In the illustrated embodiment, the separator tank 54 and base 20 are coupled at two pivot points. Multiple pivot pins 62 may support the separator tank 54, or a single elongated rod may pass through the separator tank 54 and base 20 to pivotally couple the parts. The airend 58 and separator tank 54 pivot about a pivot axis 66 that passes through the pivot pins 62.

In the arrangement shown in FIG. 3, the separator tank 54 is positioned horizontally. Maintenance service points 70 for the separator tank 54 are located on the side of the separator tank 54 facing away from the motor 22 and near the enclosure 14 to provide ease of serviceability and access for the maintenance service points 70. As shown in FIG. 1, the maintenance service points 70 include an oil fill hole. The oil fill hole is located on the side of the separator tank 54 at approximately the proper oil fill level to prevent the separator tank 54 from being overfilled with oil. Since the oil fill hole is on the side of the separator tank 54, any excess oil poured into the oil fill hole will drain out of the oil fill hole. In comparison, if the oil fill hole was on the top of the separator tank 54, the separator tank 54 could be overfilled with oil, and oil could be poured above the proper oil fill level.

The airend 58 intakes air and pressurizes the air to pressures above normal atmospheric pressure. The airend 58 and separator tank 54 are integrated together into a single unit. The airend 58 is rigidly mounted directly to the top of the separator tank 54, such that the outlet from the airend 58 is coupled directly to the inlet of the separator tank 54. In the illustrated embodiment, there are no additional pipes, fittings or tubes leading from the airend 58 to the separator tank 54 through which pressurized air passes. Since the airend 58 is directly connected to the separator tank 54, there are fewer places for leaks to occur than in a compressor in which the airend and separator tank are connected with pipes or tubes. In the illustrated embodiment, the airend 58 is bolted to the separator tank 54, but other fasteners could be used to mount the airend 58 to the separator tank 54.

In conventional compressor systems, brackets, fixtures or structures are used to support the airend. These brackets require additional material and take up additional space within the compressor system. In the illustrated embodiment, the separator tank 54 is made from cast iron or another material sufficiently strong to fully support the airend 58, and no additional support brackets are needed for the airend 58. The integrated airend 58 and separator tank 54 reduce the number of components needed for the compressor system 10, reduce the amount of space occupied by the compressor system 10, and increase the ease of assembly and maintenance serviceability.

The second pulley 46 is mounted to the airend 58. The airend 58 includes an airend shaft 72 that extends outwardly from the airend 72, and the second pulley 46 is mounted to the airend shaft 72. In the illustrated embodiment, the airend shaft 72 is substantially parallel to the output shaft 28 of the motor 22. The rotation of the motor 22 is transferred through the belt 50 from the first pulley 42 to the second pulley 46, and the second pulley 46 drives the airend 58.

As mentioned above, the motor 22 is rigidly mounted to the base 20, and the airend 58 and separator tank 54 are together pivotally mounted to the base 20. The pulley center distance between the first pulley 42 and second pulley 46 may be increased or decreased by pivoting the airend 58 and separator tank 54 with respect to the motor 22. Therefore, the tension of the belt 50 may be adjusted by pivoting the airend 58 and separator tank 54 with respect to the motor 22. Pivoting the airend 58 away from the motor 22 will increase the tension in the belt 50, and pivoting the airend 58 toward the motor will decrease the tension in the belt 50. In the illustrated embodiment, a belt tensioner 74 is interconnected to the airend 58 and the enclosure 14. The belt tensioner 74 includes a threaded rod, and may adjust the position of the airend 58 to pivot the airend 58 with respect to the motor 22.

Figure 5:
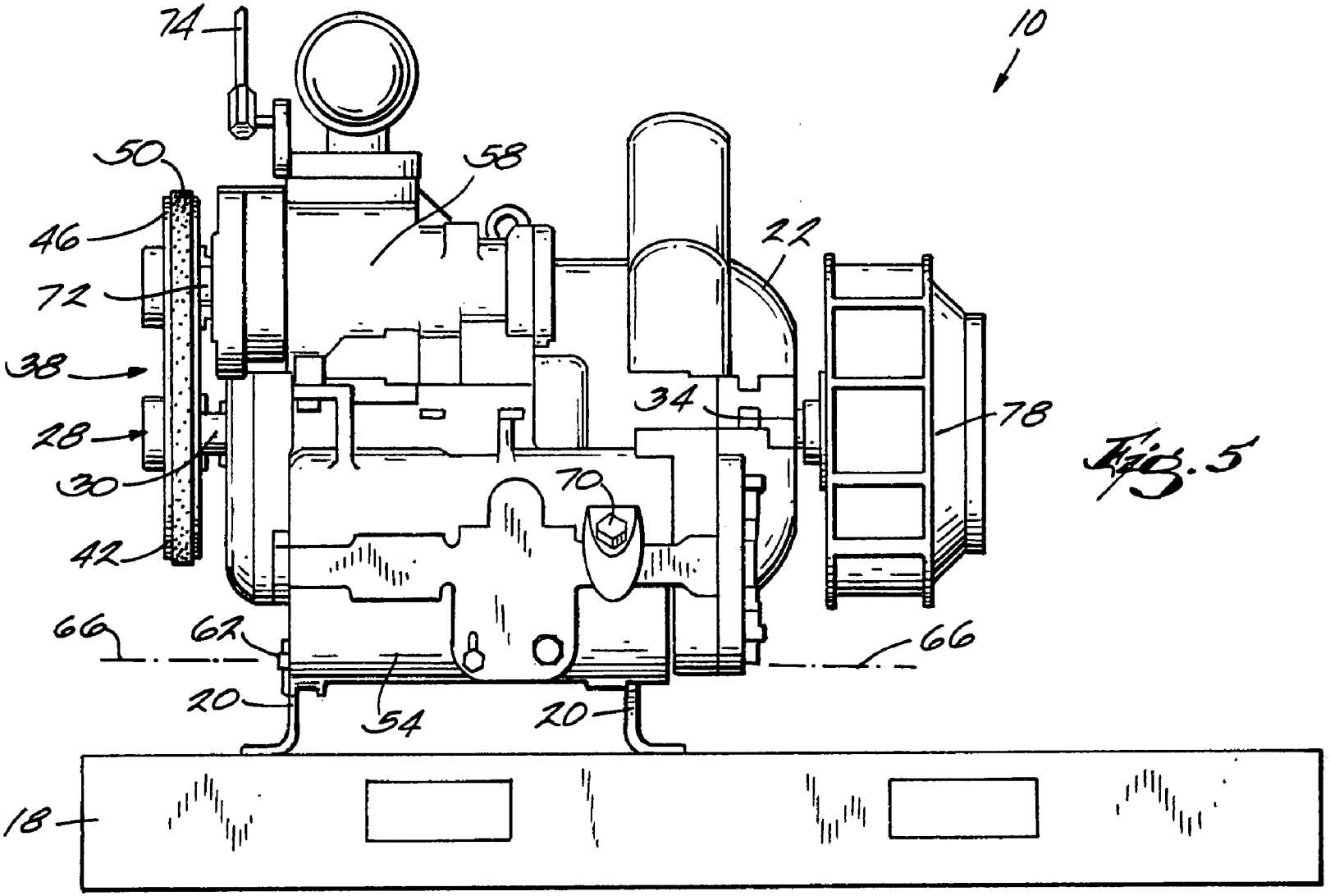
FIG. 5 is an elevation view of the compressor system of FIG. 1.

As shown in FIG. 5, an impeller 78 is mounted to the non-drive side shaft 34 of the motor 22, and the motor 22 directly drives the impeller 78. The impeller 78 is used to draw air into the enclosure 14. FIG. 2 illustrates the non-drive side shaft 34 extending from the motor 22, and the impeller 78 disposed near an inlet cone 82. Due to the tight tolerances required between the impeller 78 and the inlet cone 82, the motor 22 driving the impeller 78 is rigidly mounted to the base 20.

Many prior art compressor systems use a propeller fan to create an air flow through the enclosure. As described above, prior art compressor systems may drive the fan with the same main motor shaft that drives the airend, but if the motor is pivotally mounted the fan is limited to a propeller fan due to the tolerances required by an impeller fan. Additionally, existing compressor systems may have separate motors that drive the airend and the fan.

In the illustrated embodiment, the motor 22 drives both the airend 58 and the impeller 78. The motor 22 is rigidly mounted so the impeller 78 may be used to create an air flow through the enclosure 14. The impeller 78 is desirable because an impeller fan generally creates more static pressure than a propeller fan to force air through the enclosure 14. The air flow through the enclosure 14 is needed to cool the motor 22, airend 58, and other components of the compressor system 10. The impeller 78 can create a superior air flow for the compressor system 10 in comparison to a propeller fan, but the impeller 78 must be stable because of the tight fit between the impeller 78 and the inlet cone 82.

The invention claimed is:

1. A compressor system comprising:

an enclosure having a base;

a motor mounted to the base, wherein the motor is disposed within the enclosure;

an airend rigidly connected to a separator tank, the airend and separator tank comprising a single unit movably mounted with respect to the base and with respect to the motor: and a drive system interconnecting the motor and the airend to transmit power from the motor to the airend.

2. The compressor system of claim 1 wherein the separator tank is pivotally mounted to the base.

3. The compressor system of claim 1, wherein the separator tank is a substantially cylindrical container having a longitudinal axis and the separator tank being mounted such that the longitudinal axis extends in a substantially horizontal direction.

4. The compressor system of claim 1, wherein the separator tank has maintenance service points disposed on the side of the separator tank near the enclosure, and facing away from the motor.

5. The compressor system of claim 1, wherein the separator tank is made of cast iron, and the separator tank supports the airend.

6. The compressor system of claim 1, wherein the drive system includes a first pulley coupled to the motor, a second pulley coupled to the airend, and a belt interconnected to the first pulley and second pulley, wherein rotation of the first pulley causes the second pulley to rotate.

7. The compressor system of claim 6, wherein the airend and separator tank pivots with respect to the motor to adjust the tension of the belt.

8. The compressor system of claim 1, wherein the motor is a dual shafted motor having a drive side shaft extending from a first end of the motor, and a non-drive side shaft extending from a second end of the motor opposite the first end, wherein the drive side shaft is interconnected to the drive system that powers the airend, and the non-drive side shaft is interconnected to an impeller.

9. The compressor of claim 8, wherein an inlet cone is disposed near the impeller, and the impeller creates an air flow within the enclosure.

* * * * *